US011534786B2

(12) United States Patent
Shen et al.

(10) Patent No.: US 11,534,786 B2
(45) Date of Patent: Dec. 27, 2022

(54) LIQUID PROPORTIONING MACHINE

(71) Applicant: ZHENGZHOU SANHUA TECHNOLOGY & INDUSTRY CO., LTD., Henan (CN)

(72) Inventors: Ruhua Shen, Henan (CN); Huan Li, Henan (CN)

(73) Assignee: HENGZHOU SANHUA TECHNOLOGY & INDUSTRY CO., LTD., Henan (CN)

( * ) Notice: Subject to any disclaimer, the term of this patent is extended or adjusted under 35 U.S.C. 154(b) by 428 days.

(21) Appl. No.: 16/777,573

(22) Filed: Jan. 30, 2020

(65) Prior Publication Data

US 2020/0246822 A1 Aug. 6, 2020

(30) Foreign Application Priority Data

Jan. 31, 2019 (CN) ..... 201910096721.X
Jan. 31, 2019 (CN) ..... 201920172182.9

(51) Int. Cl.
*B05B 12/02* (2006.01)
*B05B 9/04* (2006.01)

(52) U.S. Cl.
CPC ..... *B05B 12/02* (2013.01); *B05B 9/0403* (2013.01)

(58) Field of Classification Search
CPC ..... B05B 12/02; B05B 9/0403; B05B 7/2478; B05B 15/50; B01F 33/84; F04B 9/14;
(Continued)

(56) References Cited

U.S. PATENT DOCUMENTS 3,037,671 A * 6/1962 Cochran ..... B01F 35/892 222/134
9,316,216 B1 * 4/2016 Cook ..... F04B 13/02
(Continued)

*Primary Examiner* — Vishal Pancholi
(74) *Attorney, Agent, or Firm* — Hamre, Schumann, Mueller & Larson, P.C.

(57) ABSTRACT

A liquid proportioning machine includes at least two liquid storage mechanisms for storing liquid, pump bodies for pumping liquid from the liquid storage mechanisms, and liquid discharge locations connected with liquid outlets of the pump bodies and ejecting liquid; and the liquid storage mechanisms are respectively connected with the corresponding pump bodies, and a regulating mechanism for keeping a proportion for the liquid discharge speeds of the pump bodies is arranged between the pump bodies. The pump body includes a rotating shaft, and the rotating shaft rotates to cause the pump body to pump and discharge the liquid; and the regulating mechanism includes a driving shaft driven by a driving mechanism to rotate, and the driving shaft drives the rotating shafts of the liquid storage mechanisms to rotate through a transmission mechanism and maintains a proportion for the rotating speeds between the rotating shafts. The driving shaft drives any rotating shaft to rotate through a first transmission mechanism, and a second transmission mechanism is arranged between other rotating shafts and the rotating shaft directly driven by the driving shaft. In the present invention, an automatic proportioning manner is adopted, so the proportion of various kinds of liquid does not need to be manually regulated, which improves the working efficiency and the proportioning accuracy, and then the quality of the product is improved. The entire device has a low cost and great market competitiveness.

7 Claims, 8 Drawing Sheets

(58) Field of Classification Search
CPC ..... F04B 23/02; F04B 23/04; F04B 49/20; F04B 13/02
USPC ..... 427/421.1
See application file for complete search history.

(56) References Cited

U.S. PATENT DOCUMENTS

2003/0146244 A1* 8/2003 Sanders ..... G01F 11/22 222/333
2010/0185322 A1* 7/2010 Bylsma ..... A61M 35/003 222/145.5

* cited by examiner

LIQUID PROPORTIONING MACHINE

FIELD OF THE INVENTION

The present invention belongs to the field of varnish proportioning, and in particular to a liquid proportioning machine.

BACKGROUND OF THE INVENTION

After paint is sprayed on vehicles or other equipment, a layer of varnish needs to be sprayed for protection. The varnish includes a curing agent and thermosetting resin, which maintain a certain proportion, and then some thinners are added as needed. In the existing proportioning method, a certain amount of curing agent is poured out manually, and then proportional thermosetting resin is poured out. This operation is time consuming, labor consuming and inefficient. Furthermore, the proportioning is not accurate, such that the varnish does not meet the actual needs.

SUMMARY OF THE INVENTION

The present invention provides a liquid proportioning machine with low cost, high efficiency and accurate proportioning.

The purpose of the present invention is achieved in the following manner: a liquid proportioning machine includes at least two liquid storage mechanisms 2 for storing liquid, pump bodies 3 for pumping liquid from the liquid storage mechanisms 2, and liquid discharge locations connected with liquid outlets of the pump bodies 3 and ejecting liquid; and the liquid storage mechanisms 2 are respectively connected with the corresponding pump bodies 3, and a regulating mechanism for keeping a proportion for the liquid discharge speeds of the pump bodies 3 is arranged between the pump bodies 3.

The pump body 3 includes a rotating shaft 30, and the rotating shaft 30 rotates to cause the pump body 3 to pump and discharge the liquid; and the regulating mechanism includes a driving shaft 5 driven by a driving mechanism to rotate, and the driving shaft 5 drives the rotating shafts 30 of the liquid storage mechanisms 2 to rotate through a transmission mechanism and maintains a proportion for the rotating speeds between the rotating shafts 30.

The driving shaft 5 drives any rotating shaft 30 to rotate through a first transmission mechanism 6, and a second transmission mechanism 7 is arranged between other rotating shafts 30 and the rotating shaft 30 directly driven by the driving shaft 5.

The second transmission mechanism 7 is a belt transmission mechanism, a belt pulley 70 is arranged on the rotating shaft 30 of the pump body 3, and a belt 71 is arranged between the belt pulleys 70 of the two rotating shafts 30; and the radius of at least one of the belt pulleys 70 is adjustable, which is called an adjusting belt pulley.

The adjusting belt pulley includes a fixing plate 73, a conical liftable adjusting wedge 74 is arranged on the fixing plate 73, at least two fan-shaped belt pulleys 75 are arranged on the fixing plate 73 along the circumference of a conical surface of the adjusting wedge 74, inner side surfaces of the fan-shaped belt pulleys 75 are in contact with the conical surface of the adjusting wedge 74, outer sides surfaces of the fan-shaped belt pulleys 75 away from the adjusting wedge 74 are circular ring surfaces, the belt 71 is arranged on the circular ring surfaces, and the distances from the outer sides surfaces of the fan-shaped belt pulleys 75 to the central axis of the adjusting wedge 74 are the same.

The liquid proportioning machine further includes a machine body 1, a spray head seat bracket 8 is arranged on the machine body 1, a spray head seat 81 is arranged on the spray head seat bracket 8, nozzles 82 are arranged in the spray head seat 81, and the nozzles 82 are respectively connected with the corresponding pump bodies 3 through pipelines; the liquid discharge locations are located below the nozzles 82; and a movable moisturizing cover 82 covering the spray head seat 81 is arranged below the spray head seat 81.

Two outer arms 83 and two inner arms 84 are arranged between the two sides of the moisturizing cover 82 and the corresponding sides of the spray head seat bracket 8 above the same; the spray head seat bracket 8, the outer arm 83, the moisturizing cover 82 and the outer arm 83 form a four-link mechanism; the spray head seat bracket 8, the inner arm 84, the moisturizing cover 82 and the inner arm 84 form a four-link mechanism, one end of each of the two outer arms 83 close to the moisturizing cover 82 extends to form an extension end, and the extension ends are connected by a handle 85; and a spring seat 86 is arranged above a hinge joint of the outer arms 83, the inner arms 84 and the spray head seat bracket 8 on the spray head seat bracket 8, and springs 87 for covering the moisturizing cover 82 on the spray head seat 80 are respectively arranged among the spring seat 86, the outer arms 83 and the inner arms 84.

The driving mechanism is the handle 10 arranged on the driving shaft 5, and the handle 10 is rotated to drive the driving shaft 5 to rotate.

The liquid proportioning machine is a varnish proportioning machine, the liquid storage mechanism 2 includes a soft bag 20 and a storage tank 22, and a bag body cover is arranged on the soft bag 20; the lower part of the soft bag 20 and the lower part of the storage tank 22 are respectively connected with the liquid inlets of the two pump bodies 3, that is, a first pump body 31 and a second pump body 32 through pipelines; and the rotating speed ratio of the rotating shafts 30 of the two pump bodies 3 maintains a certain proportion.

The liquid proportioning machine further includes another soft bag, called a second soft bag 21, the lower part of the second soft bag 21 is connected with the liquid inlet of another pump body 3, that is, a third pump body 33, through a pipeline, the rotating shaft 30 of the third pump body 33 is driven to rotate by a second driving shaft 11, and a first transmission mechanism 6 is arranged between the second driving shaft 11 and the rotating shaft 30 of the third pump body 33; the handle 10 is arranged at one end of the second driving shaft 11; and the handle 10 is rotated to drive the second driving shaft 11 to rotate.

The beneficial effect of the present invention is that, an automatic proportioning manner is adopted, so the proportion of various kinds of liquid does not need to be manually regulated, which improves the working efficiency and the proportioning accuracy, and then the quality of the product is improved. The radius of the belt pulley can be fine tuned to offset the error and maintain the proportioning accuracy. The entire device has a low cost and great market competitiveness.

1 represents a machine body, 2 represents a liquid storage mechanism, 20 represents a soft bag, 21 represents a second soft bag, 22 represents a storage tank, 3 represents a pump body, 30 represents a rotating shaft, 31 represents a first pump body, 32 represents a second pump body, 33 represents a third pump body, 5 represents a driving shaft, 6 represents a first transmission mechanism, 7 represents a second transmission mechanism, 70 represents a belt pulley, 71 represents a belt, 73 represents a fixing plate, 74 represents an adjusting wedge, 75 represents a fan-shaped belt pulley, 76 represents an adjusting rod, 8 represents a spray head seat bracket, 80 represents a spray head seat, 81 represents a nozzle, 82 represents a moisturizing cover, 83 represents an outer arm, 84 represents an inner arm, 85 represents a handle, 86 represents a spring seat, 87 represents a spring, 9 represents a paint mixing cup, 10 represents a handle, 11 represents a second driving shaft, 12 represents a filter, 13 represents a spray gun.

DETAILED DESCRIPTION OF THE EMBODIMENTS

Figure 1:
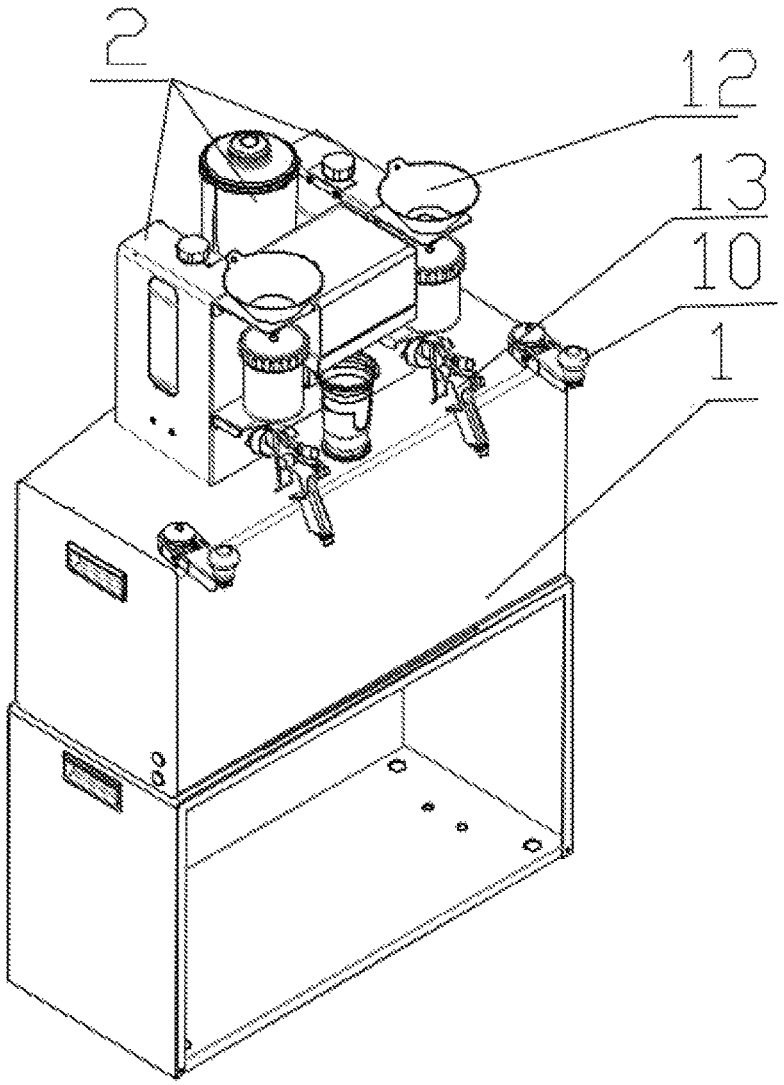
FIG. 1 is an overall schematic diagram of the present invention.
Figure 2:
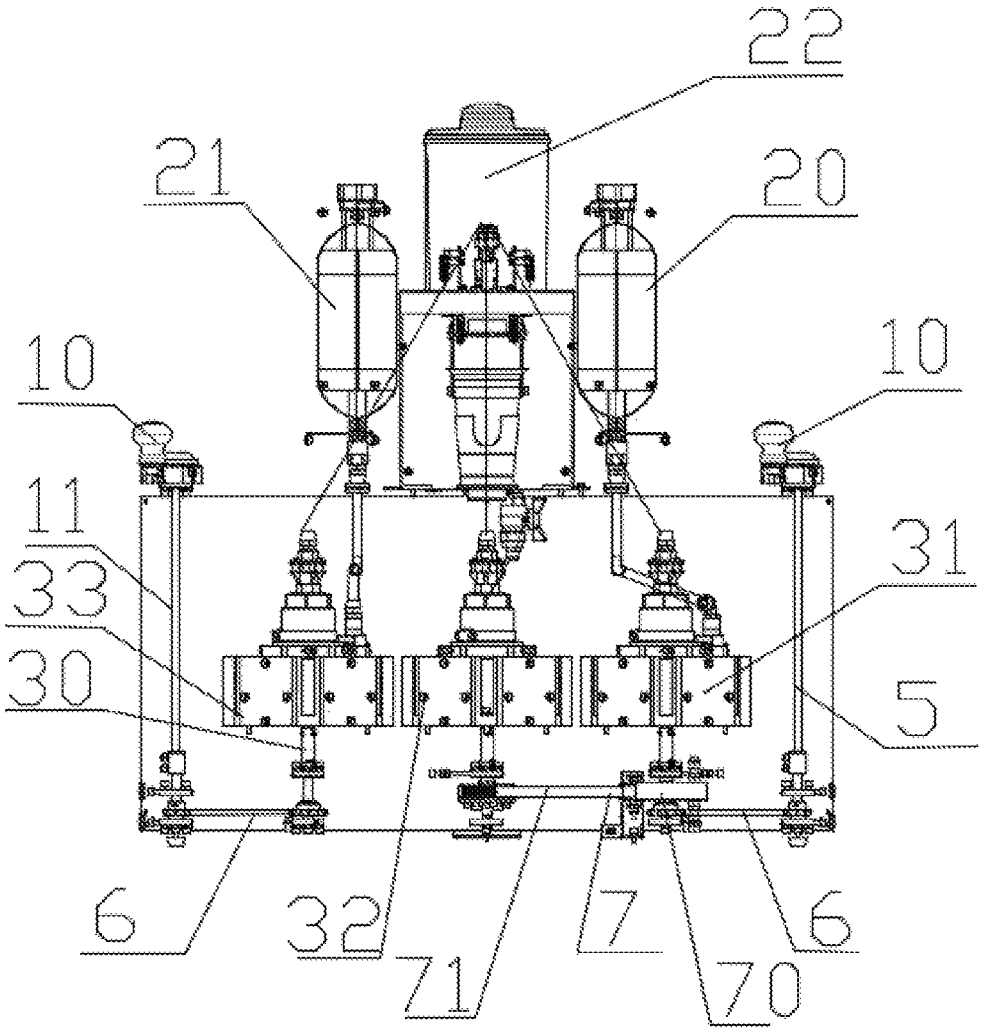
FIG. 2 is a schematic diagram of a hidden part shell, a spray gun and a part of pipeline in FIG. 1.
Figure 3:
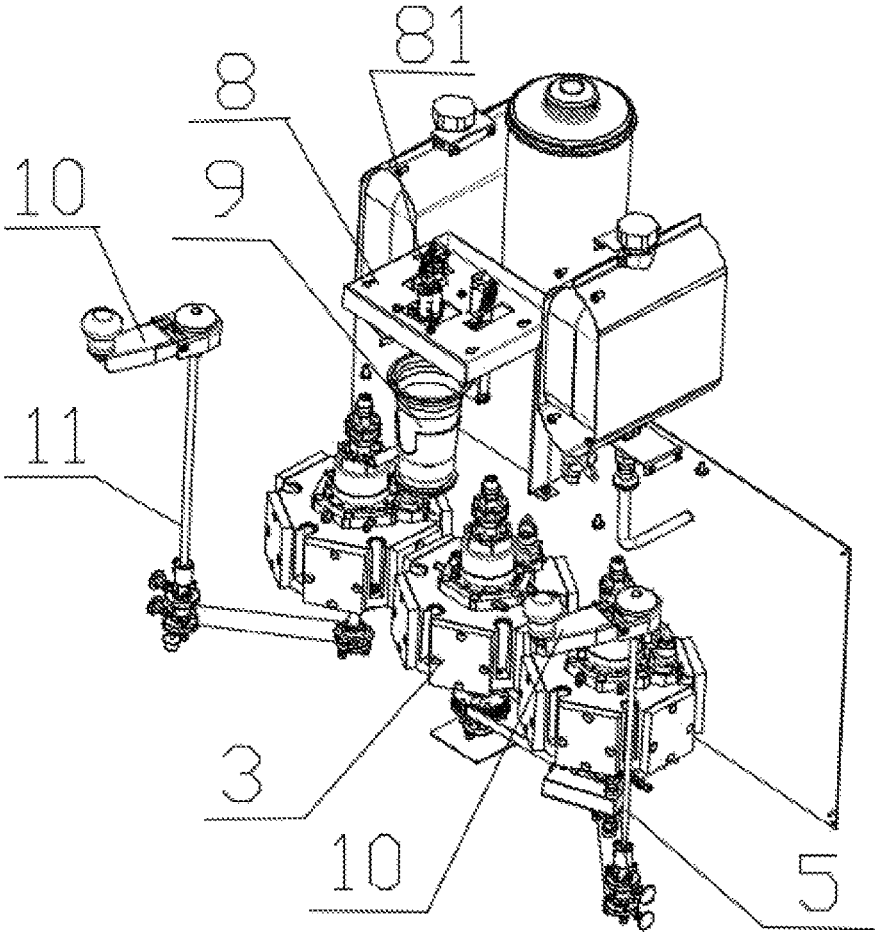
FIG. 3 is a space diagram of FIG. 2.
Figure 4:
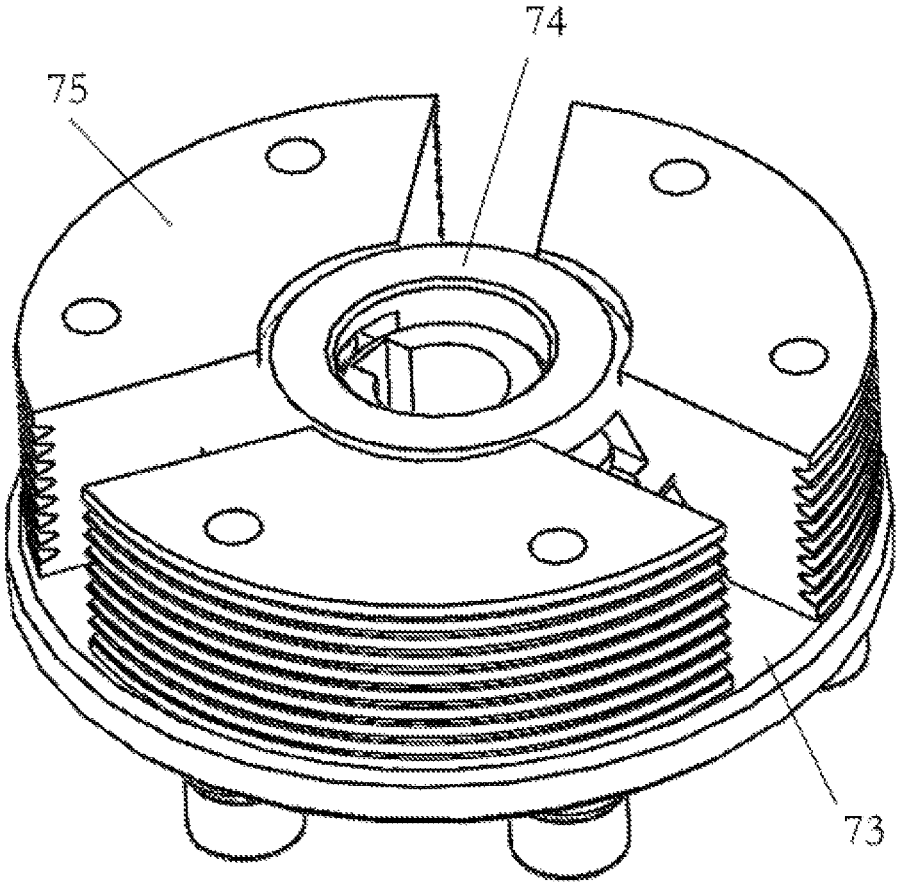
FIG. 4 is a schematic diagram of an adjusting belt pulley.
Figure 5:
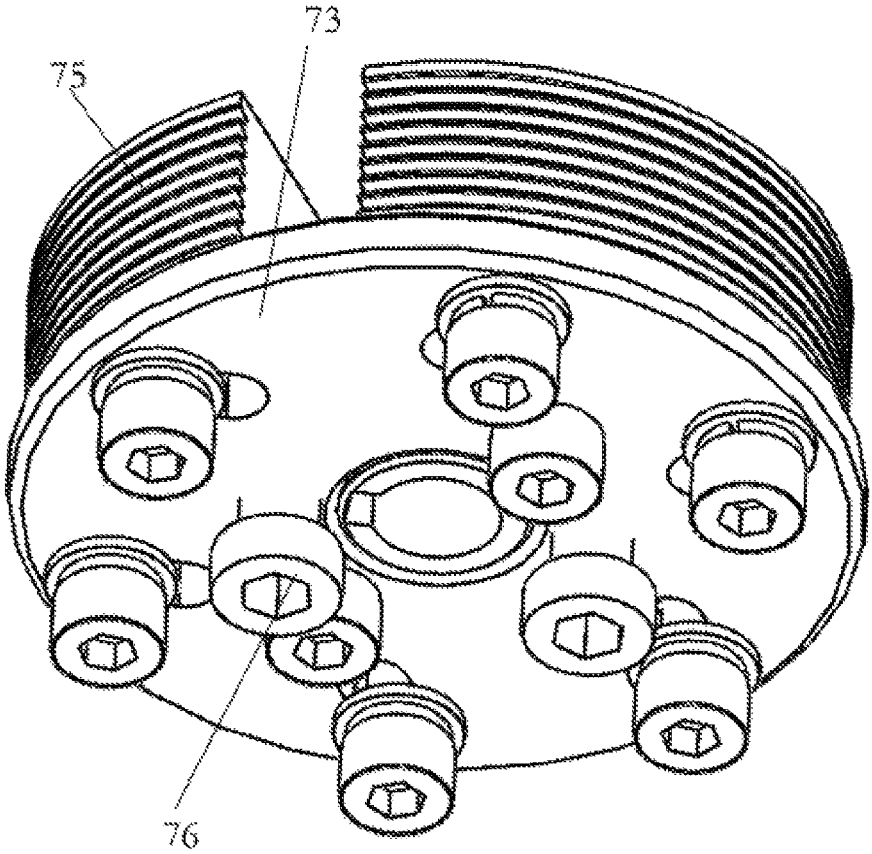
FIG. 5 is a bottom view of FIG. 4.
Figure 6:
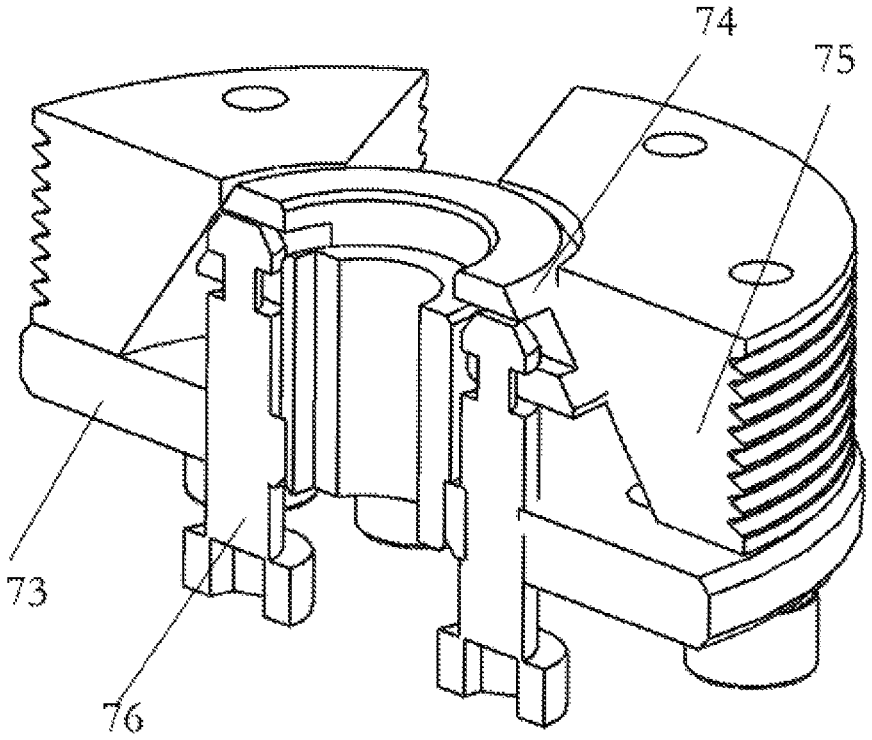
FIG. 6 is a sectional view of FIG. 4.
Figure 7:
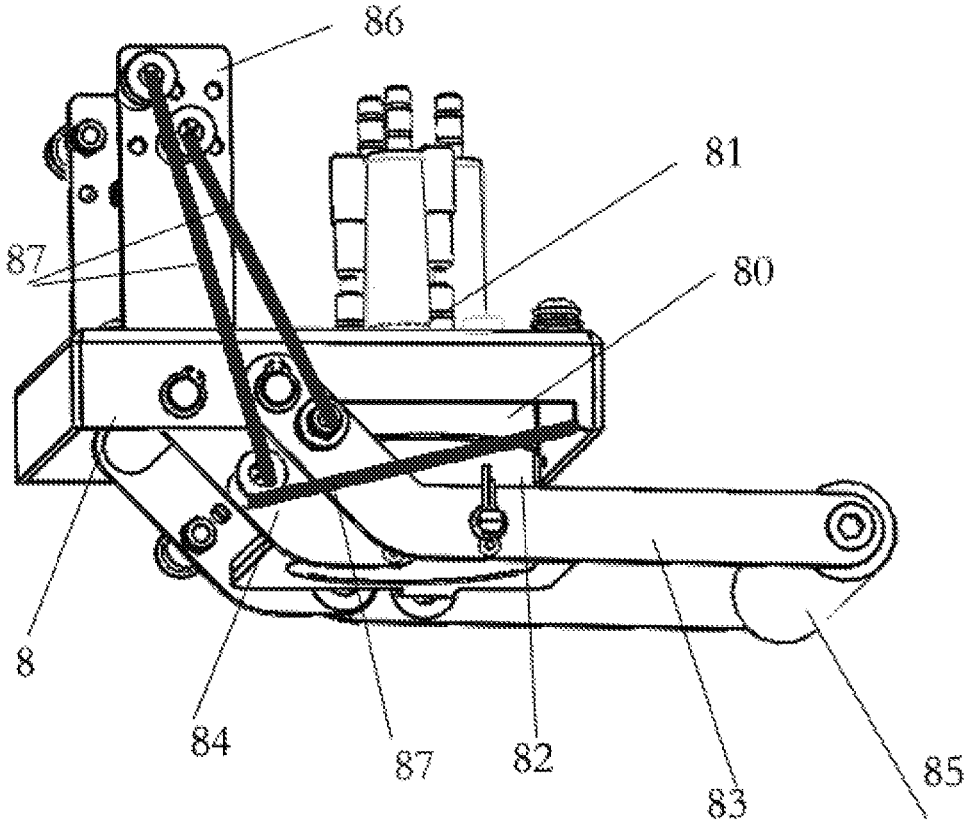
FIG. 7 is a schematic diagram of a spray head seat bracket and a four-link mechanism.
Figure 8:
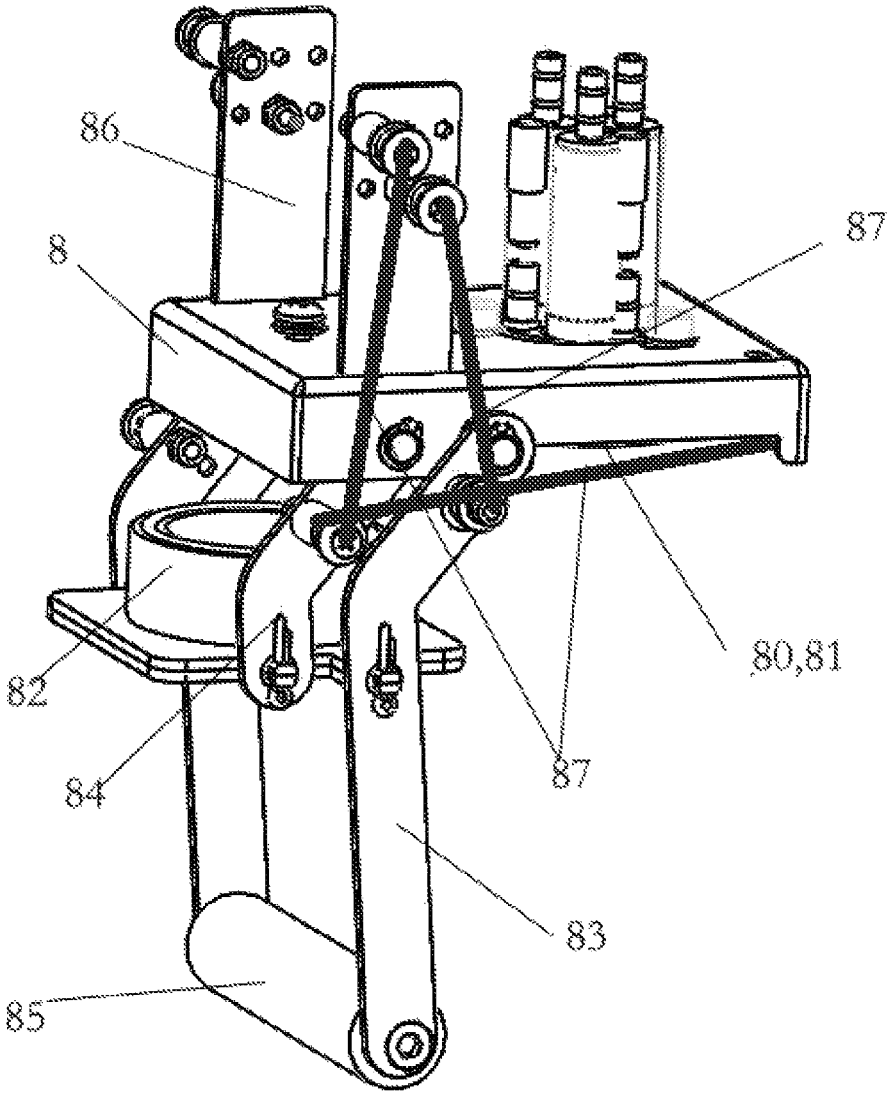
FIG. 8 is a schematic diagram of another position in FIG. 7.

As shown in FIG. 1 to FIG. 8, a liquid proportioning machine includes at least two liquid storage mechanisms 2 for storing liquid, pump bodies 3 for pumping liquid from the liquid storage mechanisms 2, and liquid discharge locations connected with liquid outlets of the pump bodies 3 and ejecting liquid. The liquid storage mechanisms 2 are respectively connected with the corresponding pump bodies 3, and a regulating mechanism for keeping a proportion for the liquid discharge speeds of the pump bodies 3 is arranged between the pump bodies 3. The liquid storage mechanisms 2, the pump bodies 3 and the liquid discharge locations are connected through pipelines, and a valve control switch can also be disposed. An automatic proportioning manner is adopted, so the proportion of various kinds of liquid does not need to be manually regulated, which improves the working efficiency and the proportioning accuracy, and then the quality of the product is improved.

The pump body 3 includes a rotating shaft 30, the rotating shaft 30 rotates to cause the pump body 3 to pump and discharge the liquid, for example, the pump body in CN203022984U. The regulating mechanism includes a driving shaft 5 driven by a driving mechanism to rotate, and the driving shaft 5 drives the rotating shafts 30 of the liquid storage mechanisms 2 to rotate through a transmission mechanism and maintains a proportion for the rotating speeds between the rotating shafts. The rotating speed ratio between the rotating shafts 30 keeps the liquid discharge speeds of the pump bodies 3 to a required proportion, and the specific proportion is determined as needed. The pump body 3 can be a rotary pump, a plunger pump, or the like; and as long as the rotation angle of the rotating shaft 30 affects the liquid output of the pump body 3. The driving mechanism can be manual or a motor. In order to reduce the cost, it is preferable to manually rotate the driving shaft 5. The transmission mechanism is a belt transmission mechanism or a chain wheel transmission mechanism or a gear transmission mechanism, or other transmission mechanisms, as long as the rotating speed of the rotating shaft can meet the needs.

The driving shaft 5 drives any rotating shaft 30 to rotate through a first transmission mechanism 6, and a second transmission mechanism 7 is arranged between the other rotating shafts 30 and the rotating shaft shaft 30 directly driven by the driving shaft 5. Of course, the driving shaft 5 can directly drive a plurality of rotating shafts through a plurality of transmission mechanisms, respectively.

The second transmission mechanism 7 is exemplified by a belt transmission mechanism, a belt pulley 70 is arranged on the rotating shaft of the pump body 3, and a belt 71 is arranged between the belt pulleys 70 of the two rotating shafts 30; and the radius of at least one of the belt pulleys 70 is adjustable, which is called an adjusting belt pulley. The first transmission mechanism 6 can be a synchronous belt transmission. The radius of the belt pulley 70 is adjustable, it can be set as multiple concentric belt pulleys with different diameters, similar to a gear transmission, and it can also be set as other mechanisms. In this way, the rotating speed ratio between the rotating shafts can be adjusted or fine tuned.

The adjusting belt pulley includes a fixing plate 73, a conical liftable adjusting wedge 74 is arranged on the fixing plate 73, at least two fan-shaped belt pulleys 75 are arranged on the fixing plate 73 along the circumference of a conical surface of the adjusting wedge 74, inner side surfaces of the fan-shaped belt pulleys 75 are in contact with the conical surface of the adjusting wedge 74, outer sides surfaces of the fan-shaped belt pulleys 75 away from the adjusting wedge 74 are circular ring surfaces, the belt 71 is arranged on the circular ring surfaces, and the distances from the outer sides surfaces of the fan-shaped belt pulleys 75 to the central axis of the adjusting wedge 74 are the same. An adjusting rod 76 is arranged on the fixing plate 73, one end of the adjusting rod 76 is arranged in the adjusting wedge 74, and the other end of which is connected with the fixing plate 73 after passing through the fixing plate 73. The adjusting rod 76 can be provided with threads, and the fixing plate 73 can be provided with a threaded hole, the adjusting rod 76 and the fixing plate 73 are connected through threads and are raised and lowered, thereby raising and lowering the adjusting wedge 74. The conical surface of the adjusting wedge 74 is in contact with the inner side surfaces of the fan-shaped belt pulleys 75, the adjusting wedge 74 ascends and descends, the fan-shaped belt pulleys 75 move toward a direction departing from or approaching to the adjusting wedge 74, so as to adjust the radius of the entire adjusting belt pulley. The fan-shaped belt pulleys 75 are slidably arranged on the fixing plate 73, that is, slot holes are formed in the fixing plate 73, and bolts for fixing the fan-shaped belt pulleys 75 are arranged in the slot holes. When the fan-shaped belt pulleys 75 move to appropriate positions, the bolts are fixed. The rotating speed ratio between the rotating shaft 30 where the adjusting belt pulley is located and other rotating shafts 30 can be fine tuned by this adjustment method, so that the proportion is accurate. In the case of an assembly error, the proportion can be accurately adjusted; and when the belt becomes loose or tight, an adjustment role can also be achieved.

The liquid proportioning machine further includes a machine body 1, a spray head seat bracket is arranged on the machine body 1, a spray head seat 80 is arranged on the spray head seat bracket 8, nozzles 81 are arranged in the spray head seat 80, and the nozzles 81 are respectively connected with the corresponding pump bodies 3 through pipelines; and the liquid discharge locations are located below the nozzles 81. A movable moisturizing cover 82 covering the spray head seat 80 is arranged below the spray head seat 80. In a normal state, the moisturizing cover 82 covers the spray head seat 80, the covering here means covering the open end of the spray head seat 80 to prevent the nozzles 81 from contacting the air too much. In order to reduce the cost, the matching relationship between the spray head seat 80 and the moisturizing cover 82 may not be provided, as long as the spray head seat and the moisturizing cover are in contact and are pressed.

When the liquid needs to be received, the moisturizing cover 82 is removed. The moisturizing cover 82 corresponds to the shape of the spray head seat 80. The spray head seat 80 may have a hollow inner shape, and the nozzles 81 are arranged in hollow inside. The moisturizing cover 82 can also be cylindrical and has a hollow interior.

Two outer arms 83 and two inner arms 84 are arranged between the two sides of the moisturizing cover 82 and the corresponding sides of the spray head seat bracket 8 above the same. The spray head seat bracket 8, the outer arm 83, the moisturizing cover 82 and the outer arm 83 form a four-link mechanism. The spray head seat bracket 8, the inner arm 84, the moisturizing cover 82 and the inner arm 84 form a four-link mechanism. One end of each of the two outer arms 83 close to the moisturizing cover 82 extends to form an extension end, and the extension ends are connected by a handle 85. A spring seat 86 is arranged above a hinge joint of the outer arms 83, the inner arms 84 and the spray head seat bracket 8 on the spray head seat bracket 8, and springs 87 for covering the moisturizing cover 82 on the spray head seat 80 are respectively arranged among the spring seat 86, the outer arms 83 and the inner arms. When varnish needs to be prepared, the handle 85 is pushed by a paint mixing cup 9 to move toward the inner side, until the paint mixing cup 9 reaches a predetermined position, at this time, the extension ends of the outer arms 83 are basically in a vertical state, and the two springs 87 are also basically in the vertical state or in a state of respectively tilting forward and backward for approximately the same angle. In this state, the resultant force of component forces of the two springs 87 in the horizontal direction is small, and the force applied by the handle 85 to the paint mixing cup 9 is very small, so that the paint mixing cup 9 is pushed away from the original position by the handle 85. After the paint is received, the paint mixing cup 9 is taken away, and the four-link mechanism drives the moisturizing cover 82 to move forward to cover the spray head seat 80. In addition, the hinge points of the outer arms 83, the inner arms 84 and the spray head seat bracket 8 are located on the inner side of the spray head seat bracket 8, the springs 87 can also be arranged between the outer side of the spray head seat bracket 8 and the upper parts of the inner arms, thereby ensuring that one side of the moisturizing cover 82 located on the outer side of the spray head seat bracket 8 can be tightly fitted with the spray head seat 80 without leaving a gap. In this way, three springs are arranged between the four-link mechanisms on each side. The specific setting of the springs is determined according to demands, as long as it is ensured that the moisturizing cover is tightly closed in the normal state, and that the resultant force on the paint mixing cup 9 in a liquid receiving state is small.

In addition, the driving mechanism is the handle 10 arranged on the driving shaft 5, and the handle 10 is rotated to drive the driving shaft 5 to rotate. The handle 10 is arranged on the machine body 1, and the liquid storage mechanisms 2 are arranged in the machine body 1.

The liquid proportioning machine is a varnish proportioning machine, the liquid storage mechanism 2 includes a soft bag 20 and a storage tank 22, and a bag body cover is arranged on the soft bag 20. The lower part of the soft bag 20 and the lower part of the storage tank 22 are respectively connected with the liquid inlets of the two pump bodies 3, that is, a first pump body 31 and a second pump body 32 through pipelines. The rotating speed ratio of the rotating shafts 30 of the two pump bodies 3 maintains a certain proportion. The soft bag 20 can isolate the air and avoid changes in liquids that are easily volatile or deteriorated. The bag body cover and the soft bag 20 are sealed. After the liquid is added to the soft bag 20, the soft bag 20 is squeezed by a hand to extrude out the remaining gas from the mouth of the bag, and then the bag body cover is closed for sealing. In the present implementation, the liquid proportioning machine is a varnish proportioning machine. A curing agent is arranged in the soft bag 20, and thermosetting resin is arranged in the storage tank 22; and the thermosetting resin and the curing agent can be cured to form varnish after being mixed. The liquid ejection speed ratio of the thermosetting resin and the curing agent is 2 to 1, the radius ratio of the two belt pulleys 70 is 2 to 1, and other proportions can also be used.

The liquid proportioning machine further includes another soft bag, called a second soft bag 21, the lower part of the second soft bag 21 is connected with the liquid inlet of another pump body 3, that is, a third pump body 33, through a pipeline, the rotating shaft of the third pump body 33 is driven to rotate by a second driving shaft 11, and a first transmission mechanism 6 is arranged between the second driving shaft 11 and the rotating shaft 30 of the third pump body 33; the handle 10 is arranged at one end of the second driving shaft 11; and the handle 10 is rotated to drive the second driving shaft 11 to rotate. A thinner is placed in the second soft bag 21, and the thinner is added according to the customer needs without being proportioned and is singly driven. In the varnish proportioning machine herein, both the driving shaft 5 and the second driving shaft 11 are manually driven to reduce the cost to the greatest extent. In addition, the machine body 1 can also be provided with a filter 12 and a spray gun 13, and the proportioned varnish in the paint mixing cup is filtered and ejected by the spray gun 13.

In specific implementation, the required liquid is placed in the soft bag 20 and the storage tank 22. When paint proportioning is needed, the paint mixing cup 9 is placed at the liquid discharge locations, the handle 10 is rotated, and liquid with a specific proportion flows out from the nozzles 81 at the liquid discharge locations. After an appropriate amount of liquid is taken, the rotation of the handle 10 is stopped, an appropriate amount of thinner is taken, and then the mixture is used after stirring.

Various technical features of the embodiments described above can be arbitrarily combined. In order to ensure simple description, all possible combinations of the technical features in the above embodiments have not been described. However, as long as the combinations of these technical features generate no contradiction, the combinations of these technical features should be considered as the scope recorded in the present specification.

The invention claimed is:

1. A liquid proportioning machine, comprising:

at least two liquid storage mechanisms for storing liquid;

at least two pump bodies for pumping liquid from the liquid storage mechanisms;

liquid discharge locations connected with liquid outlets of the pump bodies and ejecting liquid, wherein the liquid storage mechanisms are respectively connected with the corresponding pump bodies; and a regulating mechanism for keeping a proportion for the liquid discharge speeds of the pump bodies, wherein each pump body of the pump bodies comprises a rotating shaft, and the rotating shaft rotates to cause the pump body to pump and discharge the liquid;

the regulating mechanism comprises a driving shaft driven by a driving mechanism to rotate, and the driving shaft drives the rotating shafts of the pump bodies to rotate through a transmission assembly;

the driving shaft drives any rotating shaft to rotate through a first transmission mechanism of the transmission assembly;

a second transmission mechanism of the transmission assembly is arranged between any other rotating shafts and the rotating shaft directly driven by the driving shaft, such that a rotating speed ratio of the rotating shafts of the at least two pump bodies maintains a certain proportion; and the liquid proportioning machine is a varnish proportioning machine, the liquid storage mechanisms comprise a soft bag and a storage tank, and a bag body cover is arranged on the soft bag; a lower part of the soft bag and a lower part of the storage tank are respectively connected with liquid inlets of the at least two pump bodies, that is, a first pump body and a second pump body through pipelines.

2. A liquid proportioning machine, comprising:

at least two liquid storage mechanisms for storing liquid;

at least two pump bodies for pumping liquid from the liquid storage mechanisms;

liquid discharge locations connected with liquid outlets of the pump bodies and ejecting liquid, wherein the liquid storage mechanisms are respectively connected with the corresponding pump bodies; and a regulating mechanism for keeping a proportion for the liquid discharge speeds of the pump bodies, each pump body of the pump bodies comprises a rotating shaft, and the rotating shaft rotates to cause the pump body to pump and discharge the liquid; and the regulating mechanism comprises a driving shaft driven by a driving mechanism to rotate, and the driving shaft drives the rotating shafts of the liquid storage mechanisms to rotate through a transmission mechanism and maintains a proportion for the rotating speeds between the rotating shafts, the driving shaft drives any rotating shaft to rotate through a first transmission mechanism, and a second transmission mechanism is arranged between other rotating shafts and the rotating shaft directly driven by the driving shaft, the second transmission mechanism is a belt transmission mechanism, a belt pulley is arranged on the rotating shaft of the pump body, and a belt is arranged between the belt pulleys of the two rotating shafts; and the radius of at least one of the belt pulleys is adjustable, which is called an adjusting belt pulley.

3. The liquid proportioning machine according to claim 2, wherein the adjusting belt pulley comprises a fixing plate, a conical liftable adjusting wedge is arranged on the fixing plate, at least two fan-shaped belt pulleys are arranged on the fixing plate along the circumference of a conical surface of the adjusting wedge, inner side surfaces of the fan-shaped belt pulleys are in contact with the conical surface of the adjusting wedge, outer sides surfaces of the fan-shaped belt pulleys away from the adjusting wedge are circular ring surfaces, the belt is arranged on the circular ring surfaces, and the distances from the outer sides surfaces of the fan-shaped belt pulleys to the central axis of the adjusting wedge are the same.

4. A liquid proportioning machine, comprising:

at least two liquid storage mechanisms for storing liquid;

at least two pump bodies for pumping liquid from the liquid storage mechanisms;

liquid discharge locations connected with liquid outlets of the pump bodies and ejecting liquid, wherein the liquid storage mechanisms are respectively connected with the corresponding pump bodies; and a regulating mechanism for keeping a proportion for the liquid discharge speeds of the pump bodies, wherein the liquid proportioning machine further comprises a machine body, a spray head seat bracket is arranged on the machine body, a spray head seat is arranged on the spray head seat bracket, nozzles are arranged in the spray head seat, and the nozzles are respectively connected with the corresponding pump bodies through pipelines; the liquid discharge locations are located below the nozzles; and a movable moisturizing cover covering the spray head seat is arranged below the spray head seat.

5. The liquid proportioning machine according to claim 4, wherein two outer arms and two inner arms are arranged between the two sides of the moisturizing cover and the corresponding sides of the spray head seat bracket above the same; the spray head seat bracket, the outer arm, the moisturizing cover and the outer arm form a four-link mechanism; the spray head seat bracket, the inner arm, the moisturizing cover and the inner arm form a four-link mechanism, one end of each of the two outer arms close to the moisturizing cover extends to form an extension end, and the extension ends are connected by a handle; and a spring seat is arranged above a hinge joint of the outer arms, the inner arms and the spray head seat bracket on the spray head seat bracket, and springs for covering the moisturizing cover on the spray head seat are respectively arranged among the spring seat, the outer arms and the inner arms.

6. The liquid proportioning machine according to claim 1, wherein the driving mechanism is a handle arranged on the driving shaft, and the handle is rotated to drive the driving shaft to rotate.

7. The liquid proportioning machine according to claim 1, wherein the liquid proportioning machine further comprises another soft bag, called a second soft bag, the lower part of the second soft bag is connected with the liquid inlet of another pump body, that is, a third pump body, through a pipeline, the rotating shaft of the third pump body is driven to rotate by a second driving shaft, and a first transmission mechanism is arranged between the second driving shaft and the rotating shaft of the third pump body; a handle is arranged at one end of the second driving shaft; and the handle is rotated to drive the second driving shaft to rotate.

* * * * *